US007474869B2

(12) United States Patent
Kim et al.

(10) Patent No.: US 7,474,869 B2
(45) Date of Patent: Jan. 6, 2009

(54) FIXING UNIT HAVING A BRACKET SUPPORTING PRESSURE ROLLERS AND A PAPER GUIDE AND IMAGE-FORMING APPARATUS HAVING THE SAME

(75) Inventors: Jong-sung Kim, Seoul (KR); Jin-yoon Kim, Suwon-si (KR); Jae-hoon Lee, Incheon Metropolitan (KR); Hae-seog Jo, Yongin-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 346 days.

(21) Appl. No.: 11/338,815

(22) Filed: Jan. 25, 2006

(65) Prior Publication Data

US 2006/0257179 A1 Nov. 16, 2006

(30) Foreign Application Priority Data

May 12, 2005 (KR) ..... 10-2005-0039715

(51) Int. Cl.
*G03G 15/20* (2006.01)

(52) U.S. Cl. ..... 399/322; 399/122; 399/320; 399/328

(58) Field of Classification Search ..... 399/122, 399/320, 322, 328, 331
See application file for complete search history.

(56) References Cited

U.S. PATENT DOCUMENTS 4,315,682 A * 2/1982 Parzanici ..... 399/322
4,566,778 A * 1/1986 Sasaki ..... 399/322
6,259,881 B1 * 7/2001 Nakamura ..... 399/323

FOREIGN PATENT DOCUMENTS

| | | | |
|---|---|---|---|
| CN | 1521579 A | | 8/2004 |
| JP | 63-085777 | | 4/1988 |
| JP | 07-117913 | | 5/1995 |
| JP | 09080825 A | * | 3/1997 |
| JP | 10-171283 | | 6/1998 |
| JP | 10-207277 | | 8/1998 |
| JP | 10-307501 | | 11/1998 |
| JP | 2000-016631 | | 1/2000 |
| JP | 2002-229368 | | 8/2002 |
| JP | 2004279716 A | * | 10/2004 |

* cited by examiner

*Primary Examiner*—David M Gray
*Assistant Examiner*—Ryan D Walsh
(74) *Attorney, Agent, or Firm*—Roylance, Abrams, Berdo & Goodman, L.L.P.

(57) ABSTRACT

A fixing unit fixing an image on a paper and an image-forming apparatus having the same are provided. The fixing unit includes a heat roller, pressure rollers, a bracket, springs, and a paper guide. The heat roller has a heat source therein and the pressure rollers face the heat roller to form fixing nips. The bracket rotatably supports the pressure rollers and is also adapted to pivot. The springs elastically pressurize the bracket to closely attach the pressure rollers on the heat roller and the paper guide guides a paper so that a paper jam may not occur between the pressure rollers.

21 Claims, 5 Drawing Sheets

FIXING UNIT HAVING A BRACKET SUPPORTING PRESSURE ROLLERS AND A PAPER GUIDE AND IMAGE-FORMING APPARATUS HAVING THE SAME

CROSS-REFERENCE TO RELATED PATENT APPLICATION

This application claims the benefit of Korean Patent Application No. 10-2005-0039715, filed on May 12, 2005, in the Korean Intellectual Property Office, the entire disclosure of which is hereby incorporated by reference.

BACKGROUND OF THE INVENTION

1. Field of the Invention

The present invention relates to a fixing unit and an image-forming apparatus having the same. More particularly, the present invention relates to a fixing unit having pressure rollers and an image-forming apparatus having the same.

2. Description of the Related Art

Generally, an image-forming apparatus is a device that prints an image on paper, which is a printing medium. An electrophotographic image-forming apparatus, which is a type of image-forming apparatus, includes a light-scanning unit that scans an optical signal that corresponds to an image desired to be printed on a photosensitive medium, a developing unit that supplies toner to an electrostatic latent image formed on the photosensitive medium to develop the latent image into a visual image, and a fixing unit that fixes the visual image on paper. An inkjet image-forming apparatus, which is another kind of image-forming apparatus, also tends to have a fixing unit that quickly fixes ejected ink on paper.

FIGS. 1 and 2 are sectional views of conventional fixing units.

Referring to FIG. 1, a fixing unit 10 according to a first embodiment of a conventional fixing unit includes a heat roller 11 having a heat source 12 therein to generate heat, and a pressure roller 13 closely attached to the heat roller 11 with a fixing nip N interposed. Because the fixing performance of the fixing unit is proportional to the area of the fixing nip, the diameter of the pressure roller 13 should be made large to improve the fixing performance of the fixing unit 10 having one pressure roller 13. Accordingly, it is difficult to manufacture a small-sized image-forming apparatus (not shown).

Referring to FIG. 2, a fixing unit 20 according to a second embodiment of a conventional fixing unit includes a heat roller 21 having a heat source 22 therein to generate heat, and first and second pressure rollers 23 and 25 closely attached to the heat roller 21 with the first and second fixing nips N1 and N2 interposed, respectively. Though small, the fixing unit 20 has a fixing nip of an increased area and thus improved fixing performance is expected. However, the front end of a paper that has passed through the first fixing nip N1 does not pass through the second fixing nip N2 but is caught in the second pressure roller 25, so that paper jams frequently occur, which deteriorates the reliability of the paper transfer.

Accordingly, a need exists for an image forming apparatus having an improved fixing unit that increases the reliability of paper transfer through the fixing unit by substantially preventing the occurrence of paper jams.

SUMMARY OF THE INVENTION

Embodiments of the present invention provides a fixing unit having a plurality of pressure rollers capable of improving paper-transfer reliability and an image-forming apparatus having the same.

According to an aspect of the present invention, a fixing unit includes a heat roller having a heat source therein and pressure rollers facing the heat roller to form fixing nips therebetween. A bracket rotatably supports the pressure rollers and is also adapted to pivot. Springs elastically pressurize the bracket to closely attach the pressure rollers on the heat roller. A paper guide guides paper so that a jam does not occur between the pressure rollers.

The pressure rollers may include a pair of pressure rollers.

The paper guide may have a substantially Z-shaped cross-section and includes a support supported by the bracket, an extension part extending toward the heat roller, and a guide part guiding a paper.

The support of the paper guide may be mounted on the bracket by pressurizing the support using the spring to closely attach the support to the bracket.

The paper guide may contact the pressure roller disposed in a preceding position so that a jam does not occur between the pressure rollers.

The bracket may be grounded and static electricity charged on the pressure rollers and the paper guide may be discharged through the grounded bracket.

The paper guide may be closely attached to the heat roller so as to form a fixing nip between the paper guide and the heat roller.

The paper guide may be formed of a metal plate having a thickness of about 0.5 mm or less.

The bracket may have a boss supporting the spring. The support of the paper guide may have a hole in which the boss is fitted. The hole may have an inner diameter greater than a diameter of the boss to substantially prevent warp of the paper guide due to thermal expansion thereof.

The springs may include a pair of springs pressurizing both ends of the bracket in the lengthwise direction of the bracket and a ratio of pressurizing force of the pressure rollers changes depending on a pressurizing position of the springs.

According to another aspect of the present invention, a fixing unit in an image-forming apparatus has an image-forming unit forming an image on a paper and a fixing unit fixing the image on the paper. The fixing unit includes a heat roller having a heat source therein, and pressure rollers facing the heat roller to form fixing nips. A bracket rotatably supports the pressure rollers and is adapted to pivot itself. Springs elastically pressurize the bracket to closely attach the pressure rollers on the heat roller. A paper guide guides a paper so that a jam does not occur between the pressure rollers.

The pressure rollers may include a pair of pressure rollers.

The paper guide may have a substantially Z-shaped cross-section and include a support supported by the bracket, an extension part extending toward the heat roller, and a guide part guiding a paper.

The support of the paper guide may be mounted on the bracket by pressurizing the support using the springs to closely attach the support to the bracket.

The paper guide may contact the pressure roller disposed in a preceding position so that a jam does not occur between the pressure rollers.

The bracket may be grounded and static electricity charged on the pressure rollers and the paper guide may be discharged through the grounded bracket.

The paper guide may be closely attached to the heat roller to form a fixing nip between the paper guide and the heat roller.

The paper guide may be formed of a metal plate having a thickness of about 0.5 mm or less.

The bracket may have a boss supporting the spring. The support of the paper guide may have a hole in which the boss is fitted. The hole may have an inner diameter greater than a diameter of the boss to prevent warp of the paper guide due to thermal expansion thereof.

The springs may include a pair of springs pressurizing both ends of the bracket in the lengthwise direction of the bracket and a ratio of pressurizing force of the pressure rollers may change depending on a pressurizing position of the springs.

Other objects, advantages, and salient features of the invention will become apparent from the detailed description, which, taken in conjunction with the annexed drawings, discloses preferred exemplary embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

Exemplary embodiments of the present invention will now be described more fully with reference to the accompanying drawings.

Figure 3:
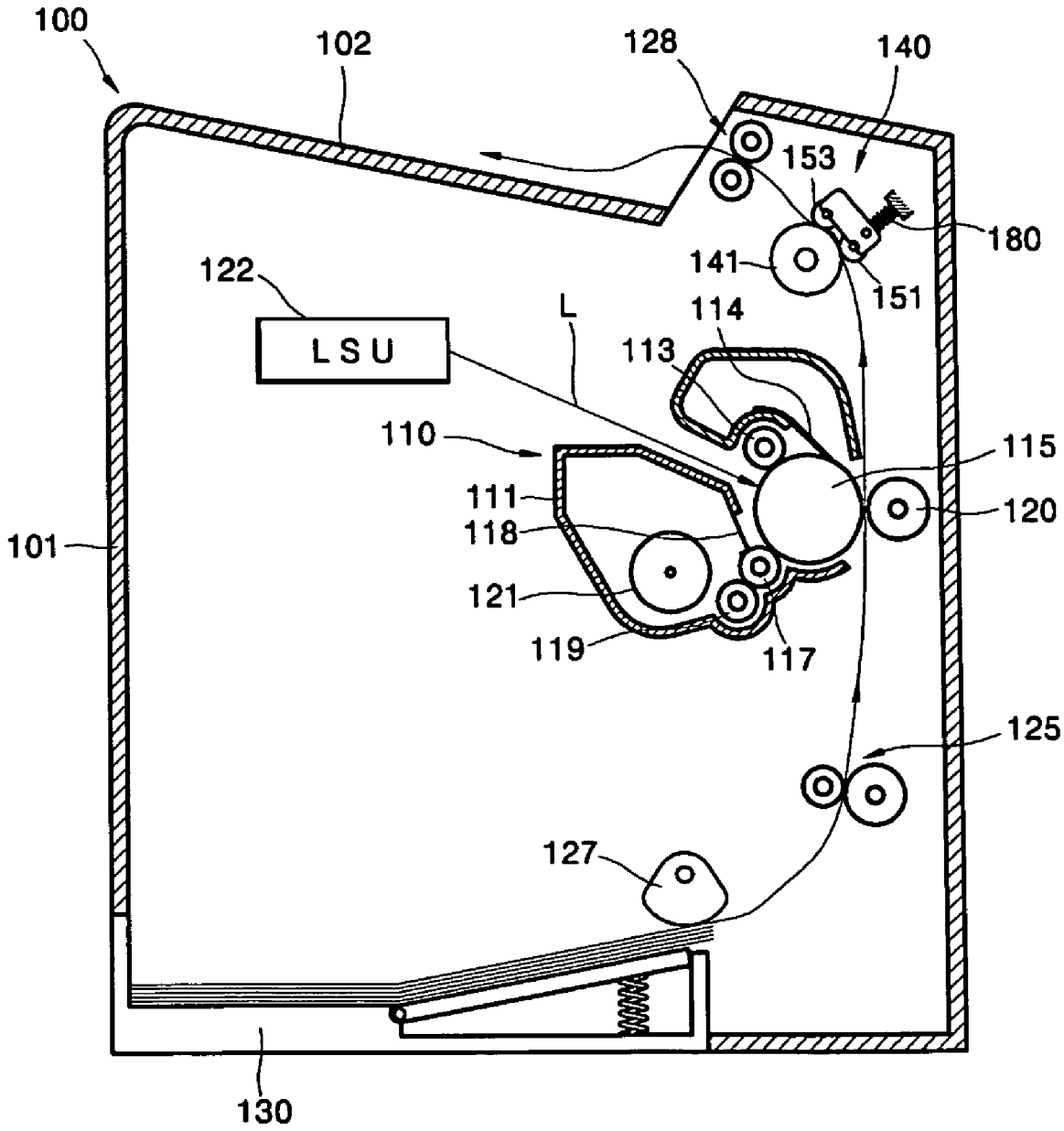
FIG. 3 is a sectional view of an image-forming apparatus according to an exemplary embodiment of the present invention.

FIG. 3 is a sectional view of an image-forming apparatus according to an exemplary embodiment of the present invention. Referring to FIG. 3, the image-forming apparatus according to a exemplary embodiment of the present invention is an electrophotographic image-forming apparatus supplying a toner, which is a developing agent, to an electrostatic latent image formed on the outer periphery of a photosensitive medium by light-scanning to develop the electrostatic latent image into a visual image, and transferring and fixing the developed visual image on paper to print a desired image. In the image-forming apparatus 100, paper is transferred along a substantially C-shaped transfer path from the bottom to the top. The image-forming apparatus 100 includes a case 101, and an image-forming unit and a fixing unit 140 formed inside of the case 101. The image-forming unit is designed for forming an image on a paper and includes a developing unit 110, a transfer roller 120, and a light-scanning unit (LSU) 122. Also, the image-forming unit 100 further includes a paper-feeding cassette 130 in which paper on which an image is to be printed is loaded and a pickup roller 127 that pick up the loaded paper from the paper-feeding cassette 130 sheet by sheet.

The developing unit 110 includes a housing 111 receiving a toner, which is a developing agent, a photosensitive medium 115 forming an electrostatic latent image by a light-scanning, a charging roller 113 charging the photosensitive medium 115, a waste toner cleaner 114 removing waste toner remaining on the photosensitive medium, a developing roller 117, a doctor blade 118 adjusting the thickness of the toner adhering on the surface of the developing roller 117, and a supply-roller 119 supplying toner to the developing roller 117. The developing roller 117 supplies toner to the electrostatic latent image formed on the outer periphery of the photosensitive medium 115 to develop a visual image on the outer periphery of the photosensitive medium 115. An agitator 121 agitates toner so that the toner is not hardened and is disposed inside of the housing 111. The developing unit 110 is provided in the form of a cartridge. When the developing agent inside of the developing unit 110 is completely exhausted, the developing unit 110 is preferably replaced by a new developing unit.

The transfer roller 120 is disposed to face and contact the photosensitive medium 115 and pressurizes a paper to the side of the photosensitive medium 115 so that the visual image developed on the outer periphery of the photosensitive medium 115 may be transferred to the paper passing between the transfer roller 120 and the photosensitive medium 115.

The light-scanning unit 122 scans an optical signal that corresponds to an image to be printed on the photosensitive medium 115 and may be a laser-scanning unit (LSU) having a laser diode (LD) for a light source.

The fixing unit 140 includes a heat roller 141 and a pair of pressure rollers 151 and 153 disposed to face the heat roller 141. When a visual image-transferred paper passes between the heat roller 141 and the pressure rollers 151 and 153, the visual image is fixed on the paper by thermal compression using heat and pressure.

Also, the image-forming apparatus 100 further includes a paper aligner 125 feeding the paper picked up by the pickup roller 127 to the image-forming unit and orderly aligning the paper so that a visual image may be transferred on the desired portion of the paper. The image-forming apparatus 100 further includes a discharge roller 128 discharging an image-printed paper to an output tray 102 outside of the case 101.

The photosensitive medium 115 is charged to a predetermined electric potential through the charging roller 113 and an electrostatic latent image that corresponds to an image to be printed is formed on the outer periphery of the photosensitive medium 115 in response to an optical signal L scanned from the light-scanning unit 122. The toner inside of the housing 111 of the developing unit is supplied to the photosensitive medium 115 on which the electrostatic latent image is formed through the supply roller 119 and the developing roller 117, so that a visual image is developed on the outer periphery of the photosensitive medium 115. Paper loaded on the paper-feeding cassette 130 is picked up by the pickup roller 127 and fed and aligned by the paper aligner 125 and then passes through between the photosensitive medium 115 and the transfer roller 120. At this point, the visual image that has been developed on the outer periphery of the photosensitive medium 115 is transferred to a surface of a paper faced by the photosensitive medium 115. The image transferred to the paper passes through the fixing unit 114, where the paper is fixed on the paper using heat and pressure, and is transferred and loaded on the output tray 102 by the discharge roller 135.

Figure 4:
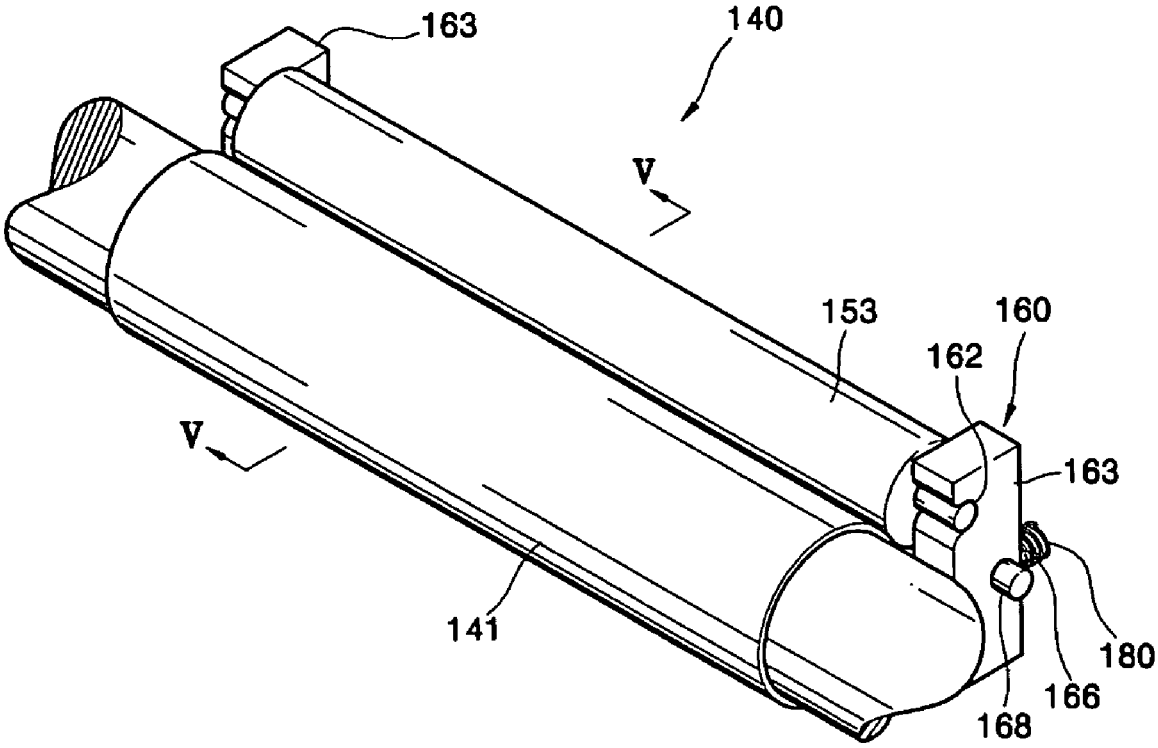
FIGS. 4 and 5 are a perspective view and a sectional view of the fixing unit of FIG. 3.
Figure 5:
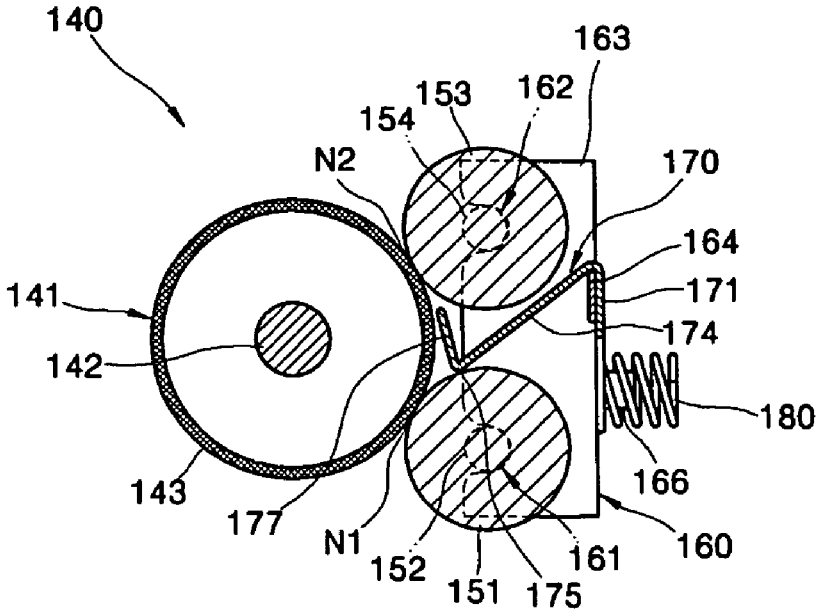
Figure 6:
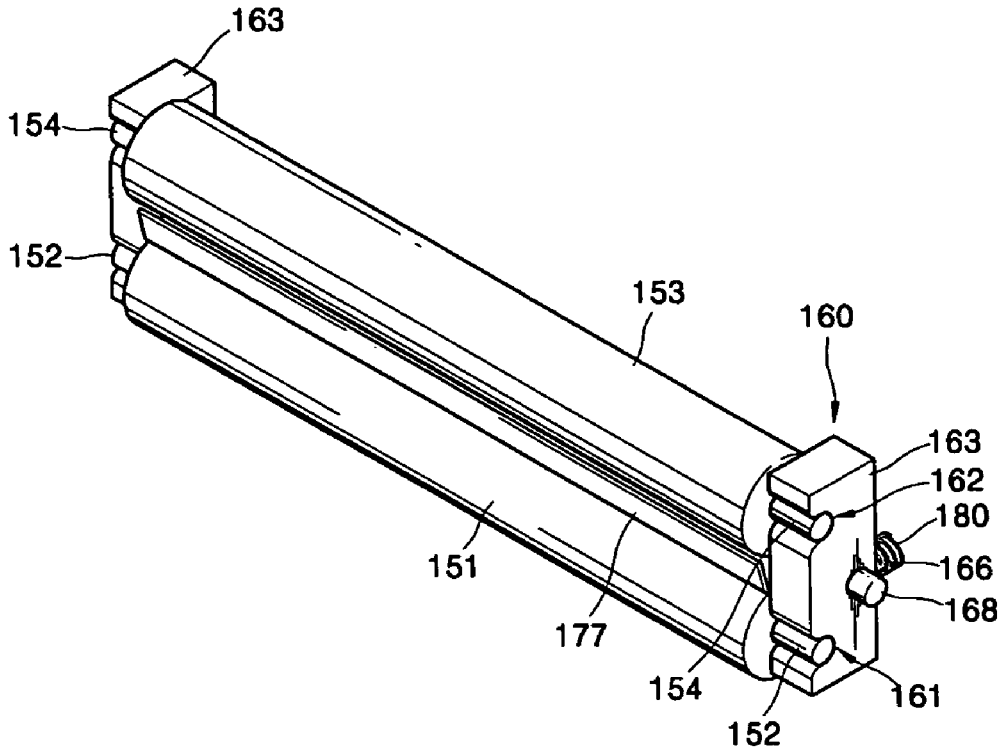
FIGS. 6 and 7 are perspective views of the fixing unit of FIG. 4 without the heat roller from other directions.
Figure 7:
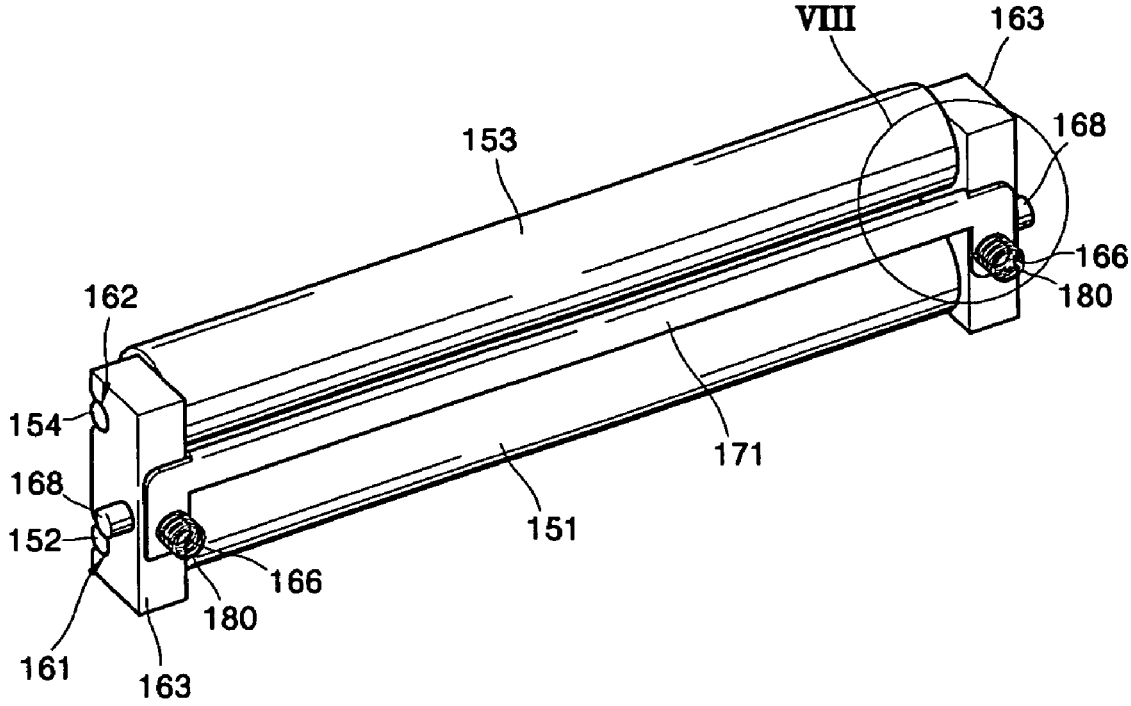
Figure 8:
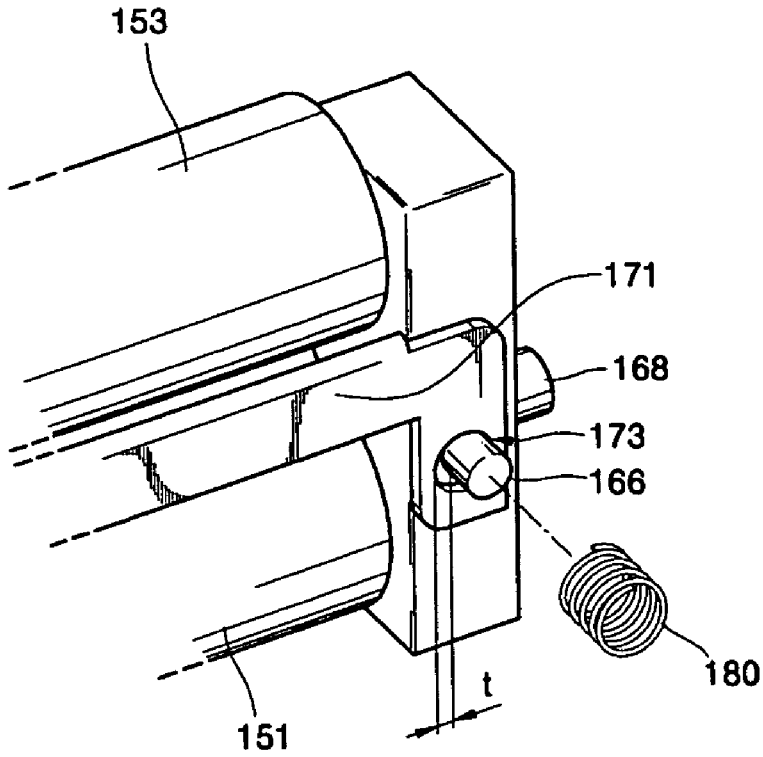
FIG. 8 is an enlarged perspective view of a portion VIII of FIG. 7.
Figure 9:
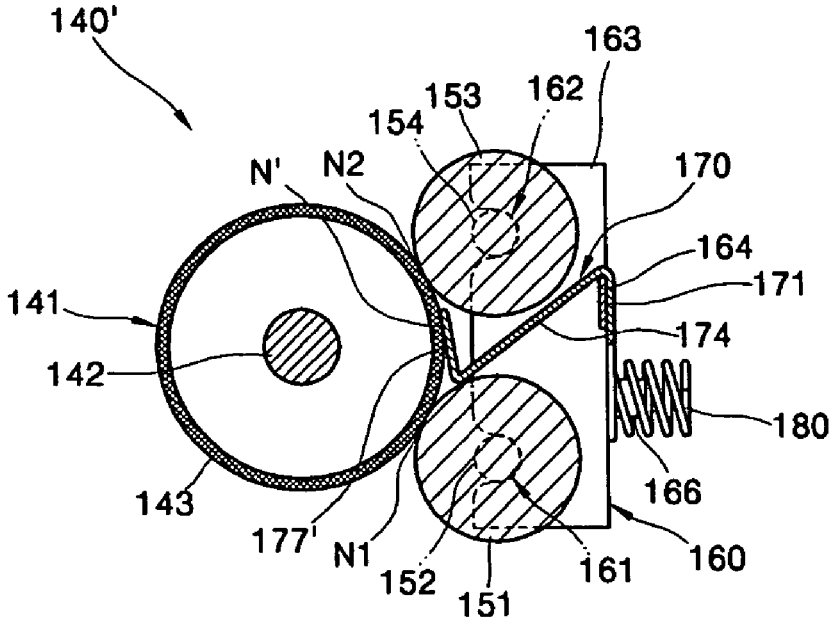
FIG. 9 is a sectional view of a fixing unit according to another exemplary embodiment of the present invention.

FIGS. 4 and 5 are a perspective view and a sectional view of the fixing unit illustrated in FIG. 3. FIGS. 6 and 7 are perspective views of other portions of the fixing unit illustrated in FIG. 4, without the heat roller, seen from other directions. FIG. 8 is an enlarged view of a portion VIII illustrated in FIG. 7. FIG. 9 is a sectional view of a fixing unit according to another exemplary embodiment of the present invention.

Referring to FIGS. 4 through 8, the fixing unit 140 (or paper handling unit) includes the heat roller 141 (or the first roller), the first and second pressure rollers 151 and 153 (the two second rollers) facing the heat roller 141 and forming fixing nips N1 and N2, a bracket 160 rotatably supporting the pressure rollers 151 and 153, and a paper guide 170 supported by the bracket 160. Preferably, there are at least two second rollers.

The heat roller 141 has a heat source 142, such as a halogen lamp, a heat coil, or an induction heater, disposed therein to apply heat on a toner-transferred paper. Also, a rubber layer 143 may be disposed on the outer periphery of the heat roller 141 to secure sufficient fixing nips.

The bracket 160 includes a pair of bracket bodies 163 disposed on both ends of a pair of pressure rollers 151 and 153, and a connection bar 164 connecting the pair of bracket bodies 163. The bracket body 163 includes the first and second seat grooves 161 and 162 rotatably supporting shafts 152 and 154 of the first and second pressure rollers 151 and 153. Also, the bracket body 163 further includes a coupling protuberance 168 protruding in the extension direction of the pressure rollers 151 and 153. Through the coupling protuberance 168, the bracket 160 is rotatably mounted in a predetermined frame (not shown) disposed inside of the case 101 and the coupling protuberance 168 serves as a pivot of the bracket 160.

The bracket 160 is elastically pressurized by an elastic member, such as a spring 180. A boss 166 is provided on the backsides of one pair of bracket bodies 163, respectively, and a pair of springs 180 are fitted on the bosses 166 to pressurize the bracket 160 to the side of the heat roller 141. Accordingly, the pair of pressure rollers 151 and 153 supported by the bracket 160 are closely attached on the heat roller 141 to form the fixing nips N1 and N2. Because the intensity of force applied to both ends of the pressure rollers 151 and 153 should be substantially uniform, the pair of springs 180 are the same and the positions of the bosses 166 are determined such that substantially the same positions of the bracket bodies 163 may be pressurized.

Figure 1:
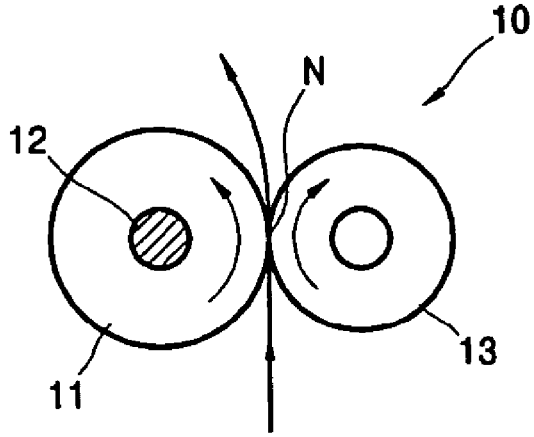
FIG. 1 (PRIOR ART)
FIGS. 1 and 2 are sectional views of conventional fixing units.
Figure 2:
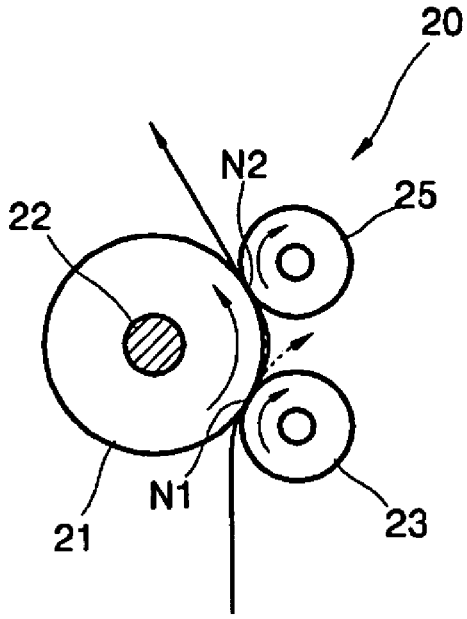
FIG. 2 (PRIOR ART)

When the pressurizing position of the spring 180 changes, the pressurizing force ratio of the first pressure roller 151 to the second pressure roller 153 changes. That is, to apply substantially the same pressurizing force to the first and second pressure rollers 151 and 153, the boss 166 is formed on the center of the bracket body 163 so that the spring 180 may pressurize the center of the bracket body 163. When the boss 166 is formed at a lower portion of the bracket body 163 so that the spring 180 may pressurize the lower portion of the bracket body 163, the pressure applied to the first pressure roller 151 is greater than the pressure applied to the second pressure roller 153. When the boss 166 is formed at an upper portion of the bracket body 163 so that the spring 180 may pressurize the upper portion of the bush body 163, the pressure applied to the first pressure roller 151 is smaller than the pressure applied to the second pressure roller 153. Therefore, the conventional fixing unit 20 illustrated in FIG. 2 requires two pairs of springs (not shown) to closely attach the pair of pressure rollers 23 and 25 on the heat roller 21, but the inventive fixing unit 140 of an exemplary embodiment of the present invention may pressurize one pair of pressure rollers 151 and 153 using only one pair of springs 150, thereby having an advantage of reducing the number of parts.

Referring to FIG. 5, the paper guide 170 has a substantially Z-shaped cross-section and includes a support 171 supported by the connection bar 164 of the bracket 160. An extension part 174 extends toward the heat roller 141. A guide part 177 guides the front end of the paper that has passed through the first fixing nip N1 to the second fixing nip N2. The paper guide 170 may be formed by press-working a metal plate. However, unlike the paper guide illustrated in the drawings, the paper guide may be formed by molding a high molecular resin. For example, to maintain proper elasticity and thermal endurance, a high molecular resin in which polyethylene-terephthalate (PET) and a glass fiber are mixed may be used for forming the paper guide.

Referring to FIG. 8, a hole 173 in which the boss 166 of the bracket body 163 is fitted is provided on both ends of the support 171. The support 171 is fitted on the boss 166 through the hole 173 and pressurized and closely attached on the bracket body 163 by the spring 180, so that the paper guide 170 is mounted on the bracket 160. The hole 173 has an inner diameter greater than the outer diameter of the boss 166, and particularly, has a sufficient inner interval t when the boss 166 is fitted therein. Since heat is transferred to the guide part 177 of the paper guide 170 during operation of the fixing unit 140, the paper guide 170 thermally expands primarily in the lengthwise direction of the pressure rollers 151 and 153. However, since the paper guide 170 has the interval t formed in the hole 173, the warp of the paper guide 170 is substantially prevented despite the thermal expansion of the paper guide 170.

The extension part 174 extends toward the heat roller 141 from the support 171 through a space between the first pressure roller 151 and the second pressure roller 153. The guide part 177 extends to enclose the outer periphery of the heat roller 141 disposed between the first and second fixing nips N1 and N2. The front end of the paper that has passed through the first fixing nip N1 is guided to the second fixing nip N2 without transferring to the second pressure roller 153 by the guide part 177 and thus the occurrence of a paper jam is suppressed.

Referring to FIG. 9, the guide part 177' may be closely attached on the outer periphery of the heat roller 141. Since another fixing nip N' is further formed between the first and second fixing nips N1 and N2 by the heat roller 141 and the guide part 177' closely attached to each other, the fixing unit 140 according to another exemplary embodiment of the present invention may have an improved fixing performance. The guide part 177' should elastically pressurize the heat roller 141 using appropriate elastic force to form the fixing nip N'. The paper guide 170 may be formed by press-working a metal plate having a thickness of about 0.5 mm or less so that the paper guide 170 may have the appropriate elastic force.

Referring again to FIG. 5, a bending portion 175 between the extension part 174 and the guide part 177 of the paper guide 170 contacts the outer periphery of the first pressure roller 151 preceding the second pressure roller 153. Accordingly, since a gap where a paper can pass is not present between the first pressure roller 151 and the bending portion 175, a jam occurrence at the fixing unit 140 may be further suppressed.

To remove static electricity generated in the fixing unit 140, the bracket 160 is grounded and the pressure rollers 151 and 153 have a conduction layer, such as a conductive teflon tube, formed on the outer periphery thereof. The paper guide 170 and the bracket 160 may be formed of a conductive material, such as metal. With such a structure, the fixing unit 140 discharges static electricity through the path of paper guide 170 to the pressure rollers 151 and 153 and to the bracket 160, even though static electricity is charged on the pressure rollers 151 and 153 and the paper guide 170 due to friction during the fixing process, so that electrostatic offset of the fixing unit 140 is substantially prevented. The structure removing static electricity of the fixing unit 140 is not limited to the structure illustrated in the drawing and the metal paper guide may be grounded without the bracket.

The visual image-transferred paper transferring to the fixing unit 140 during the printing process passes through the first fixing nip N1 and is guided to the second fixing nip N2 with a paper jam suppressed by the guide part 177 of the paper guide 170. The paper guided to the second fixing nip N2 passes through the second fixing nip N2 and is outputted from the fixing unit 140. Since the bracket 160 is pressurized to the side of the heat roller 141 by the spring 180 and pivots on the coupling protuberance 168, the pressure rollers 151 and 153 pressurize the heat roller 141 using constant pressurizing force despite the eccentricity or deformation of the heat roller 141, so that the fixing nips N1 and N2 may be substantially constantly maintained. Also, since the support 171 of the paper guide 170 is fixed on the bush 160, the heat roller 141 and the guide part 177 maintain a substantially constant distance, so that an abrupt collision is prevented. Therefore, the fixing performance improves and the occurrence of a paper jam is suppressed.

The fixing unit improves fixing performance by applying the plurality of pressure rollers to increase the area of the fixing nips and a small-sized fixing unit may be realized. Also, the paper guide is provided to prevent a paper jam during the fixing process.

According to exemplary embodiments of the present invention, only a pair of springs is used even when a plurality of pressure rollers are used, so that the number of parts is reduced, thereby reducing manufacturing costs.

Though the two pressure rollers are illustrated in the drawing, three or more pressure rollers may be applied.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A fixing unit, comprising:

a heat roller having a heat source therein;

pressure rollers facing the heat roller to simultaneously form fixing nips;

a bracket rotatably supporting the pressure rollers; and a paper guide installed on the bracket to guide a paper so that a paper jam does not occur between the pressure rollers, the paper guide being closely attached to the heat roller to form a fixing nip between the paper guide and the heat roller.

2. The fixing unit of claim 1, wherein the pressure rollers include first and second pressure rollers.

3. The fixing unit of claim 1, wherein the paper guide has a support supported by the bracket, an extension part extending toward the heat roller, and a guide part adapted to guide paper.

4. The fixing unit of claim 3, wherein the support of the paper guide is mounted on the bracket by pressurizing the support using springs to closely attach the support to the bracket.

5. The fixing unit of claim 3, wherein the paper guide is formed of a metal plate having a thickness of about 0.5 mm or less.

6. The fixing unit of claim 3, wherein the bracket has a boss supporting each of the springs, the support of the paper guide has a hole that receives the boss, and the hole has an inner diameter greater than a diameter of the boss to substantially prevent warping of the paper guide due to thermal expansion thereof.

7. The fixing unit of claim 1, wherein the paper guide contacts the pressure roller disposed in a preceding position of a paper travel path so that a jam does not occur between the pressure rollers.

8. The fixing unit of claim 1, wherein the bracket is grounded and static electricity charged on the pressure rollers and the paper guide is discharged through the grounded bracket.

9. The fixing unit of claim 1, further comprising springs pressurizing both ends of the bracket in a lengthwise direction of the bracket, wherein a ratio of a pressurizing force of the pressure rollers changes depending on a pressurizing position of the springs.

10. An image-forming apparatus having an image-forming unit forming an image on a paper and a fixing unit fixing the image on the paper, the fixing unit comprising:

a heat roller having a heat source therein;

pressure rollers facing the heat roller to simultaneously form fixing nips;

a bracket rotatably supporting the pressure rollers; and a paper guide installed on the bracket to guide a paper so that a paper jam does not occur between the pressure rollers, the paper guide being closely attached to the heat roller to form a fixing nip between the paper guide and the heat roller.

11. The apparatus of claim 10, wherein the fixing unit has a pair of pressure rollers.

12. The apparatus of claim 10, wherein the paper guide includes a support supported by the bracket, an extension part extending toward the heat roller, and a guide part guiding a paper.

13. The apparatus of claim 12, wherein the support of the paper guide is mounted on the bracket by pressurizing the support using springs to closely attach the support to the bracket.

14. The apparatus of claim 12, wherein the paper guide is formed of a metal plate having a thickness of about 0.5 mm or less.

15. The apparatus of claim 12, wherein the bracket has a boss supporting the spring, the support of the paper guide has a hole that receives the boss, and the hole has an inner diameter greater than a diameter of the boss to substantially prevent warping of the paper guide due to thermal expansion thereof.

16. The apparatus of claim 10, wherein the paper guide contacts the pressure roller disposed in a preceding position of a paper path so that a paper jam does not occur between the pressure rollers.

17. The apparatus of claim 10, wherein the bracket is grounded and static electricity charged on the pressure rollers and the paper guide is discharged through the grounded bracket.

18. The apparatus of claim 10, further comprising springs pressurizing both ends of the bracket in a lengthwise direction of the bracket, wherein a ratio of a pressurizing force of the pressure rollers changes depending on a pressurizing position of the springs.

19. A paper handling unit, comprising:

a first roller;

at least two second rollers facing the first roller to simultaneously form nips;

a bracket rotatably supporting the at least two second rollers;

at least one elastic member elastically supporting the bracket to move the at least two second rollers into contact with the first roller; and a paper guide mounted to the bracket and guiding a paper between the at least two second roller, the paper guide being closely attached to the first roller to form a fixing nip between the paper guide and the first roller.

20. The paper handling unit of claim 19, wherein the paper guide has a support supported by the bracket, and an extension part extending toward the first roller, and a guide adapted to guide paper.

21. The apparatus of claim 19, wherein the first roller is heat roller of a fixing unit; and the at least two second rollers are pressure rollers of the fixing unit.

* * * * *